US011732868B1

(12) United States Patent
Pang et al.

(10) Patent No.: US 11,732,868 B1
(45) Date of Patent: Aug. 22, 2023

(54) LIGHT EMITTING DEVICE

(71) Applicant: GUANGZHOU COLORFUL STAGE EQUIPMENT CO., LTD, Guangzhou (CN)

(72) Inventors: Haiquan Pang, Guangzhou (CN); Biao Xia, Guangzhou (CN); Minghua Yang, Guangzhou (CN)

( * ) Notice: Subject to any disclaimer, the term of this patent is extended or adjusted under 35 U.S.C. 154(b) by 0 days.

(21) Appl. No.: 17/868,814

(22) Filed: Jul. 20, 2022

(30) Foreign Application Priority Data

Jun. 6, 2022 (CN) ..... 202210631702.4

(51) Int. Cl.

| | |
|---|---|
| ***F21V 3/10*** | (2018.01) |
| ***F21S 10/00*** | (2006.01) |
| ***H05B 45/30*** | (2020.01) |
| *F21Y 115/10* | (2016.01) |
| *F21W 121/00* | (2006.01) |

(52) U.S. Cl.
CPC ..... *F21V 3/10* (2018.02); *F21S 10/00* (2013.01); *H05B 45/30* (2020.01); *F21W 2121/00* (2013.01); *F21Y 2115/10* (2016.08)

(58) Field of Classification Search
CPC . F21V 3/10; H05B 45/30; F21S 10/00; F21Y 2115/10; F21W 2121/00
USPC ..... 362/249.02
See application file for complete search history.

(56) References Cited

U.S. PATENT DOCUMENTS

2019/0319430 A1* 10/2019 Na ..... H01S 5/18388

FOREIGN PATENT DOCUMENTS

CN 201636652 U * 11/2010
DE 202006010961 U1 * 1/2007 ..... F21S 4/10

OTHER PUBLICATIONS

English translation of CN-201636652-U (Year: 2010).*
English translation of DE-202006010961-U1 (Year: 2006).*

* cited by examiner

*Primary Examiner* — Andrew J Coughlin
*Assistant Examiner* — Hana S Featherly

(57) ABSTRACT

Disclosed is a light emitting device, which includes a housing having a light transmittable portion, which has a first region and a second region; a light shield layer, covered on a wall surface of the first region; and a light emitting assembly, arranged in the housing, the light emitting assembly is configured to emit a first beam able to travel through the housing and project a pattern to an ambient environment. The light emitting assembly is further configured to emit a second beam able to transmit through the light transmittable portion; and the second beam transmitted through the first region and the light shield layer has a first brightness, the second beam transmitted through the second region has a second brightness greater than the first brightness.

16 Claims, 8 Drawing Sheets

LIGHT EMITTING DEVICE

CROSS REFERENCE OF RELATED APPLICATIONS

The present disclosure claims priority of Chinese Patent Application No. 202210631702.4, filed on Jun. 6, 2022, the entire contents of which are hereby incorporated by reference.

TECHNICAL FIELD

The present disclosure relates to the technical field of luminaires, and particularly to a light emitting device.

BACKGROUND

To enhance decorative lighting effect, a light emitting device may be configured to produce a lighting effect with changing colors or changing light and shade; and a projector may be configured to produce changing projected patterns. However, the lighting effect of the existing light-emitting device is too simple.

SUMMARY

The present disclosure provides a light emitting device, which enriches the lighting effect of the existing light-emitting devices.

A Light Emitting Device is Provided, which Includes:

a housing, including a light transmittable portion, the light transmittable portion including at least one first region and at least one second region;

a light shield layer, covered on a surface of the first region; and a light emitting assembly, arranged in the housing, the light emitting assembly being configured to emit a first beam able to travel through the housing and project a pattern to an ambient environment, wherein the light emitting assembly is further configured to emit a second beam able to transmit through the light transmittable portion; and the second beam transmitted through the first region and the light shield layer has a first brightness, the second beam transmitted through the second region has a second brightness, and the second brightness is greater than the first brightness.

According to the light emitting device provided in the embodiments of the present disclosure, a light emitting assembly is used to emit a first beam to an ambient environment, and the first beam projects a preset pattern to an ambient environment. Particularly, a light transmittable portion in a housing of the present disclosure allows a second beam emitted by the light emitting assembly to transmit. Moreover, a wall surface of the light transmittable portion is further provided with a light shield layer, which covers a wall surface of a first region of the light transmittable portion. In this way, the brightness of the second beam transmitted through a second region of the light transmittable portion is higher than the brightness of the second beam transmitted through the first region covered with the light shield layer, so that the housing of the light emitting device can present two lighting effects with at least different brightness. Thus, the lighting effect of the light emitting device is enriched.

BRIEF DESCRIPTION OF THE DRAWINGS

To describe the technical solutions according to the embodiments of the present disclosure more clearly and fully, the drawings needed to be used in the embodiments of the present disclosure will be described briefly below. Apparently, the drawings in the following description only show some embodiments of the present disclosure.

DESCRIPTION OF THE EMBODIMENTS

Figure 1:
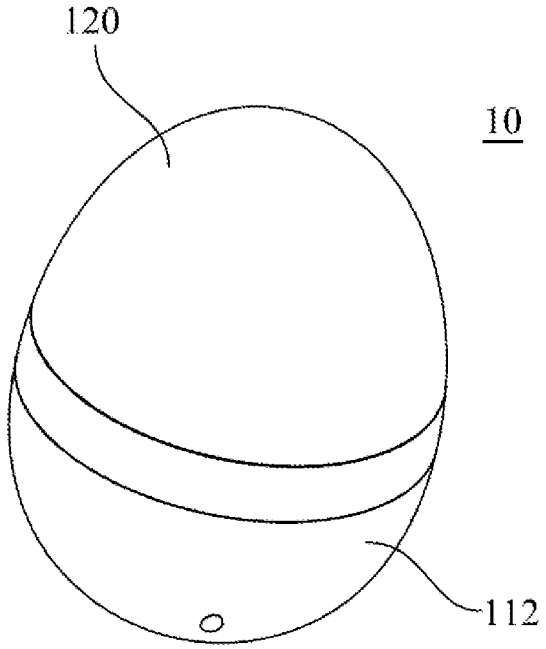
FIG. 1 shows a schematic perspective view of a light emitting device provided in a first embodiment of the present disclosure, from which a light shield layer is omitted.

To facilitate the understanding of the present disclosure, the present disclosure will be described in further detail below, with reference to the accompanying drawings and specific embodiments. It should be noted that when an element is described as being "fixed to" another element, it may be directly provided on the said element, or there can be one or more intervening elements therebetween. When an element is described as being "connected to" another element, it may be directly connected to the said element, or there may be one or more intervening elements therebetween. The terms "vertical", "horizontal", "left", "right" and similar expressions used in this specification are for illustrative purposes only.

Unless otherwise defined, all technical and scientific terms used herein have the same meaning as commonly understood by persons skilled in the art. The terms used in the descriptions of the present disclosure are for the purpose of describing specific embodiments only and not intended to limit the present disclosure. The term "and/or" as used herein includes any and all combinations of one or more of the listed related items.

Referring to FIGS. 1 to 9, a first embodiment of the present disclosure provides a light emitting device 10, which may be a lighting device, a projector, and others. For convenience of description, this embodiment is described by way of example in which the light-emitting device 10 is a projector. The projector can be specifically a starry sky projector, which can project to form a starry sky effect on an indoor wall of a user. As a result, the user can feel an atmosphere as if being in space. The starry sky projector specifically includes a housing 100, a light shield layer 200 and a light emitting assembly 300.

The housing 100 includes a light transmittable portion 130, and the light transmittable portion 130 of the housing 100 allows a beam emitted by the light emitting assembly 300 to transmit, so that the user can observe the beam emitted by the light emitting assembly 300 outside of the housing 100, or the beam emitted by the light emitting assembly 300 is transmitted through the light transmittable portion 130 and then presents a predetermined light spot effect on a projection surface such as a wall or a curtain. The housing 100 can be totally, or partially light transmittable. In this embodiment, all portions of the housing 100 that can be observed from the outside are designed to be light transmittable. The light transmittable portion 130 of the housing 100 includes at least a first region 131 and at least a second region 132. The specific shapes and sizes of the first region 131 and the second region 132 depend on specific requirements, and the relative positional relationship between the first region 131 and the second region 132 depends on specific requirements.

The light shield layer 200 has a light shielding effect. Particularly, the light shield layer 200 can totally or partially block the light. In this embodiment, the light shield layer 200 can partially block the light. That is, after the light beam emitted by the light emitting assembly 300 is transmitted through the light shield layer 200, it still presents a lighting effect. The light shield layer 200 is covered on a wall surface of the first region 131, and the light shield layer 200 may be specifically covered on an inner wall surface of the first region 131 or on an outer wall surface of the first region 131. In this embodiment, the light shield layer 200 is covered on the outer wall surface of the first region 131.

It should be noted that in the present disclosure, a region of the light transmittable portion 130 with the light shield layer 200 is defined as the first region 131, and a region of the light transmittable portion 130 without the light shield layer 200 is defined as the second region 132. In other words, the division of the first region 131 and the second region 132 depends on the position where the light shield layer 200 is arranged. As a result, the first region 131 is fully covered with material of the light shield layer 200, and the second region 132 is entirely free of the light shield layer 200.

The light emitting assembly 300 is provided inside the housing 100, and the light emitting assembly 300 is configured to emit a first beam able to travel through the housing 100 and project a pattern to an ambient environment. The first beam can be a parallel beam or a concentric beam. The pattern projected by the first beam depends on specific needs. In this embodiment, when the light emitting device 10 is a starry sky projector, the first beam can present a starry sky pattern.

Figure 8:
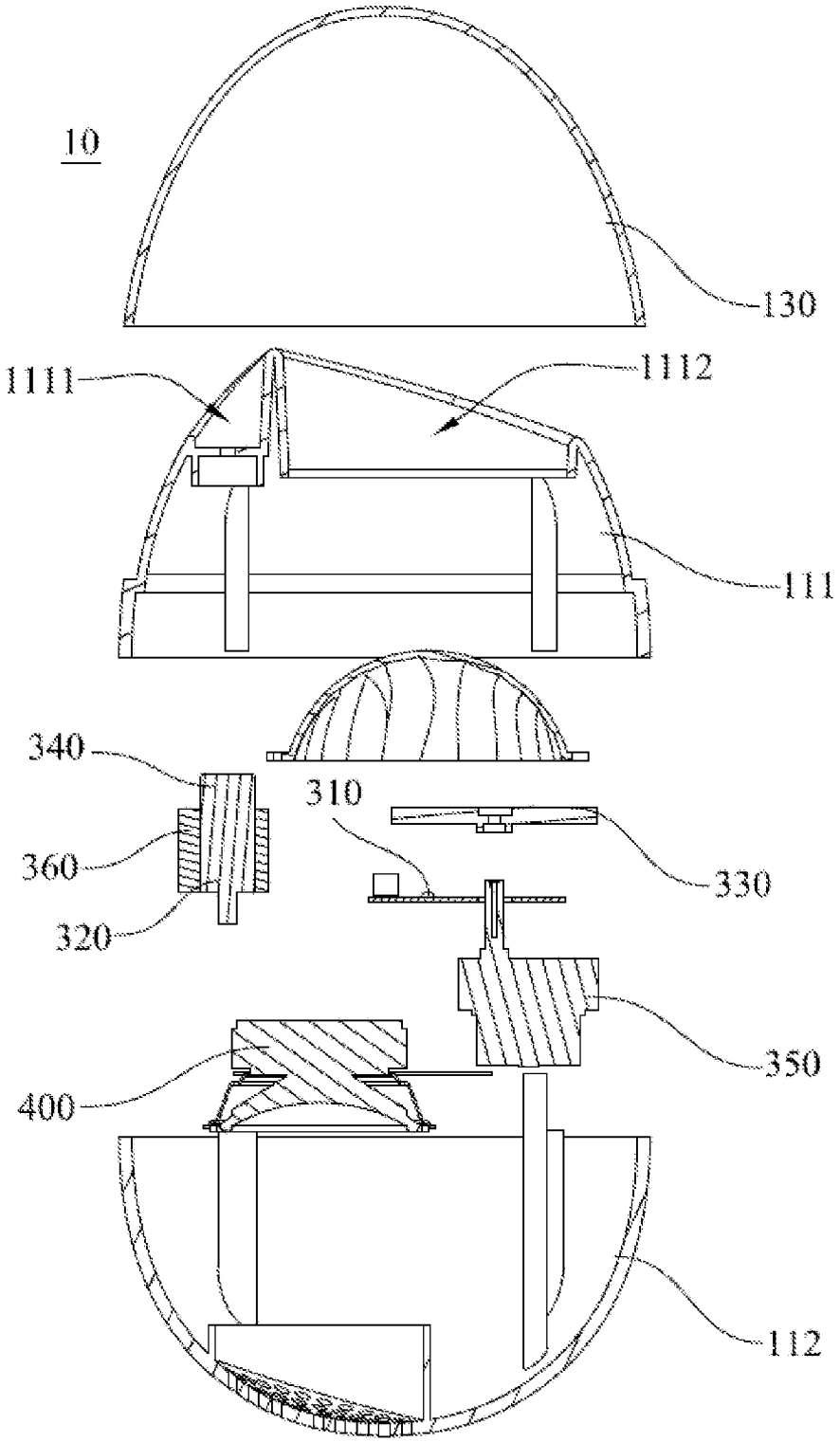
FIG. 8 shows a schematic full cross-sectional view of a fifth exploded view of the light emitting device provided in the first embodiment of the present disclosure.
Figure 9:
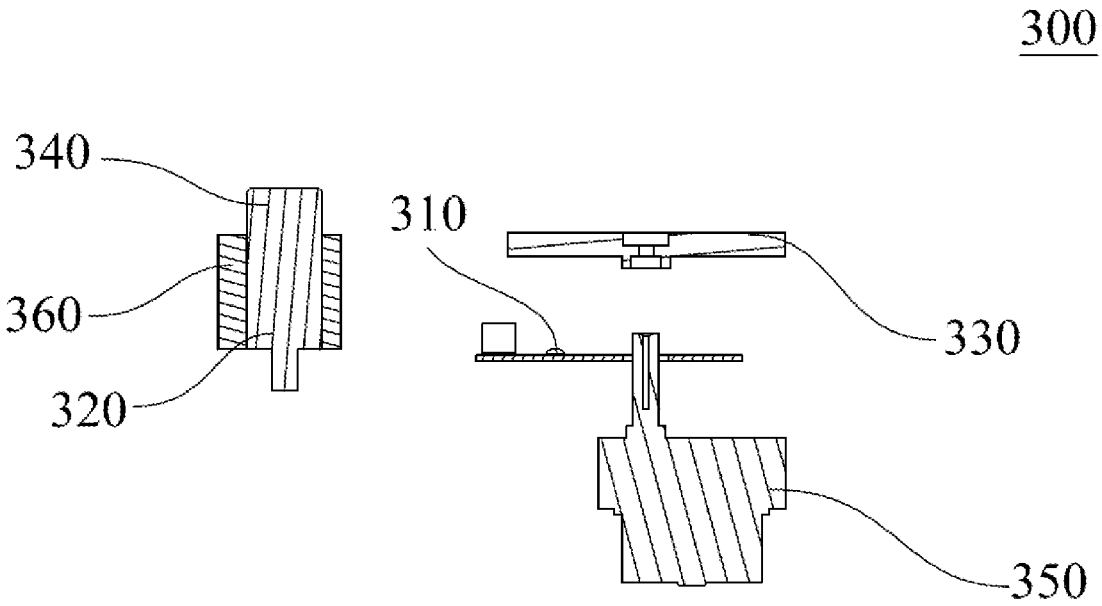
FIG. 9 shows a schematic exploded view of a light emitting assembly provided in the first embodiment of the present disclosure.

Referring to FIGS. 8 to 9, the light emitting assembly 300 is further configured to emit a second beam able to transmit through the light transmittable portion 130. The second beam can be a parallel beam or a concentric beam. The second beam transmitted through the first region 131 and the light shield layer 200 has a first brightness, and the second beam transmitted through the second region 132 has a second brightness, wherein the second brightness is greater than the first brightness. That is, as is viewed by the user, the housing 100 of the light emitting device 10 is observed to present two different lighting effects. Moreover, when the lighting effects are projected onto a wall, two kinds of light spots with different brightness effects are projected on the wall. The light spots are combined with the pattern projected by the first beam, to further enhance the atmosphere.

According to the light emitting device 10 provided in this embodiment, a light emitting assembly 300 is used to emit a first beam to an ambient environment, and the first beam projects a preset pattern to the ambient environment. Particularly, in the present disclosure, a light transmittable portion 130 of the housing 100 allows a second beam emitted by the light emitting assembly 300 to transmit. Moreover, a wall surface of the light transmittable portion 130 is further provided with a light shield layer 200, which covers a wall surface of a first region 131 of the light transmittable portion 130. As such, the brightness of the second beam transmitted through a second region 132 of the light transmittable portion 130 is higher than the brightness of the second beam transmitted through the first region 131 covered with the light shield layer 200, so that the housing 100 of the light emitting device 10 can present two lighting effects with at least different brightness. Thus, the lighting effect of the light emitting device 10 is enriched.

The specific shapes and sizes of the first region 131 and the second region 132 depend on specific requirements, and the relative positional relationship between the first region 131 and the second region 132 depends on specific requirements. To further enhance the atmosphere, in this embodiment, a plurality of first regions 131 and a plurality of second regions 132 are provided. Specifically, a plurality of cracks 220 are formed in the light shield layer 200. The cracks 220 are corresponding to the second regions 132, and the light shield layer 200 (i.e., the material of the light shield layer) is corresponding to the first regions 131. In particular, the light shield layer 200 is divided into a plurality of segments 210 by the cracks 220. Adjacent segments 210 may be or may not be connected. In particular, the shapes, lengths, and/or widths of the cracks 220 are irregular. The cracks 220 are randomly distributed. However, most or each of the cracks 220 has a length along an extension direction thereof much greater than a width thereof. For example, the length of the crack may be two times or more than the width thereof. This solution further meets the requirement of atmosphere provided by a starry sky projector.

It was found by the present applicant that since the division of the first region 131 and the second region 132 depends on the position of arrangement of the light shield layer 200, the relative positional relationship between the first region 131 and the second region 132 and their respective shapes and sizes are different as the processing and assembly methods of the light shield layer 200 are different. After the light shield layer 200 is covered onto some regions of the light transmittable portion 130, the division of the first region 131 and the second region 132 is completed. If the first region 131 and the second region 132 are divided systematically and regularly, the lighting effect presented by the starry sky projector is too uniform and anthropogenic, leading to a less starry sky atmosphere of the starry sky projector. If the light shield layer 200 is processed by an absolutely random processing method, the proportion of manual processing is too large, and the processing cost is higher.

Figure 2:
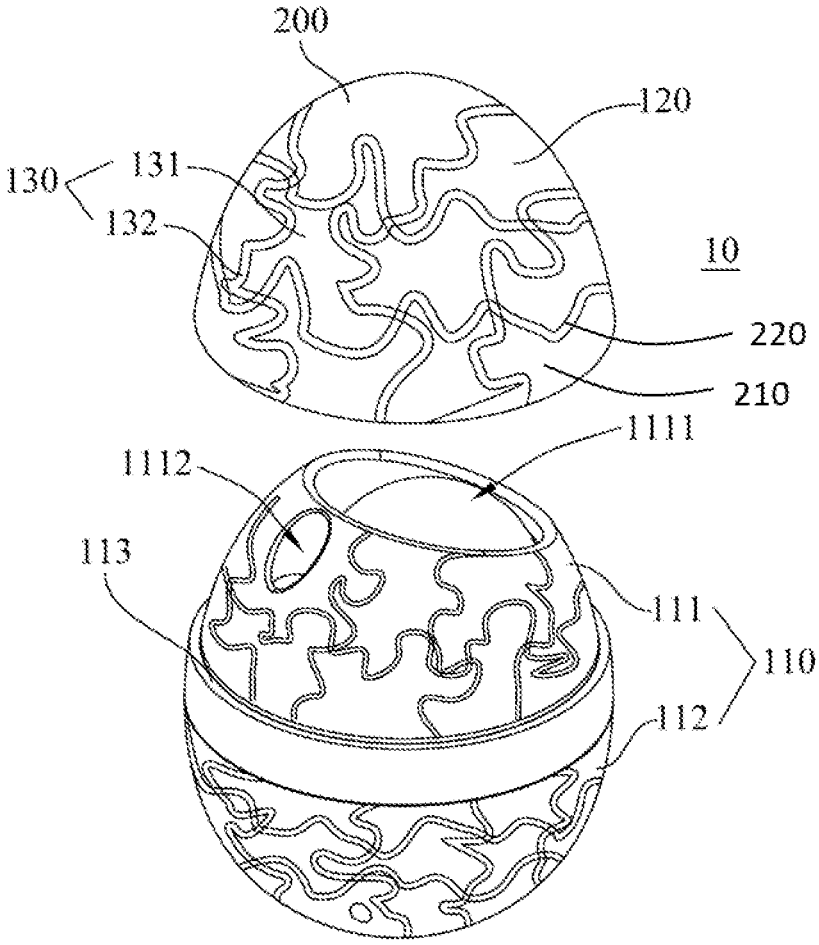
FIG. 2 shows a first schematic exploded view of the light emitting device provided in the first embodiment of the present disclosure.
Figure 2A:
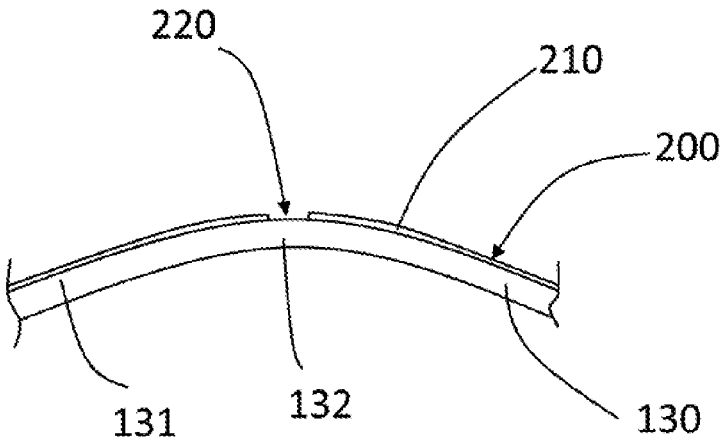
FIG. 2*a* is an enlarged view of a portion of the housing according to the first embodiment.
Figure 2B:
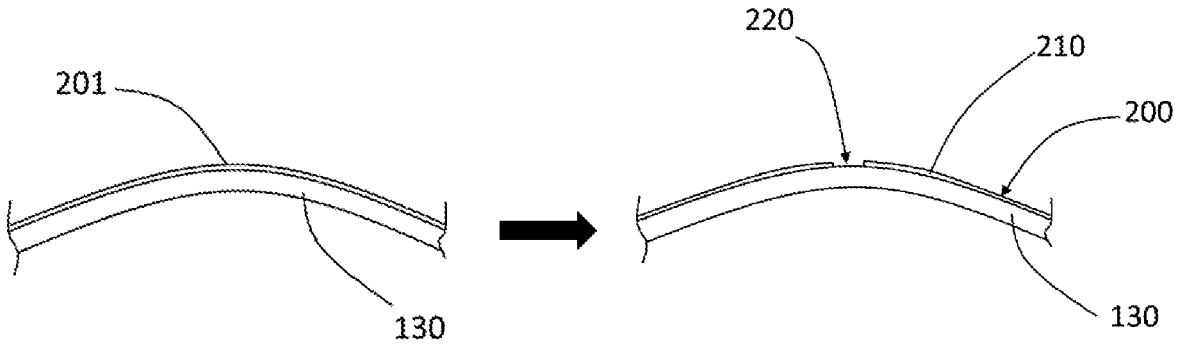
FIG. 2*b* shows a process of forming a light shield layer shown in FIG. 2*b;*

In this embodiment, to provide the first region 131 and the second region 132 arranged randomly to attain an atmosphere of starry sky effect, the light shield layer 200 may be formed by a first coating covering the light transmittable portion 130. In one implementation, as shown in FIG. 2*b*, the first coating 201 is applied onto the whole wall surface of the light transmittable portion 130, i.e., on the first regions 131 and the second regions 132. The first coating 201 may include a shrinking agent, which causes the cracks 220 when the first coating 201 is cured. For example, the first coating 201 may be crackle paint.

Alternatively, the first coating 201 may be applied exclusively on the first regions 131 by means of a tool, which preventing the second regions 132 from the first coating 201. In this implementation, as soon as the first coating 201 is applied onto the light transmittable portion 130, the first regions 131 and the second regions 132 are determined. In that case, the shrinking agent can be omitted from the first coating 201.

In order to increase the color difference between the light shield layer 200 and the second regions 132 exposed from the cracks 220, the light transmittable portion 130 may have a color significantly different from the light shield layer 200. For example, the light transmittable portion 130 may be formed in dark color, and the light shield layer 200 may be formed in light color.

Figure 2C:
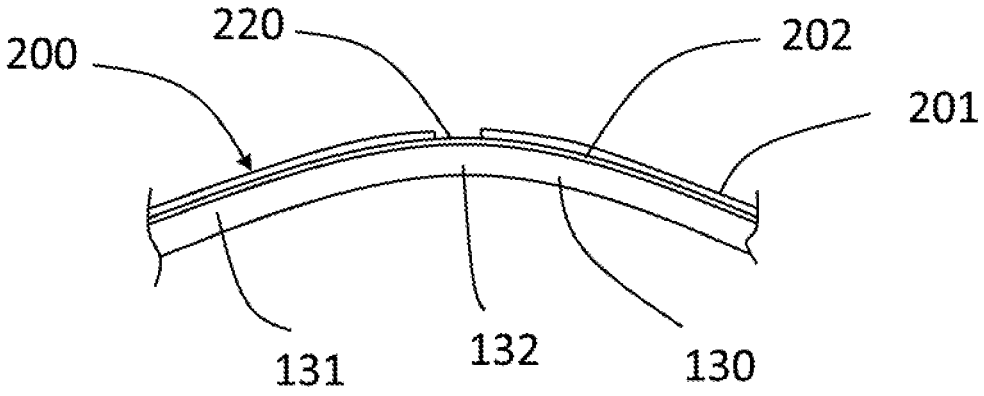
FIG. 2*c* is an enlarged view of a portion of an alternative housing.
Figure 3:
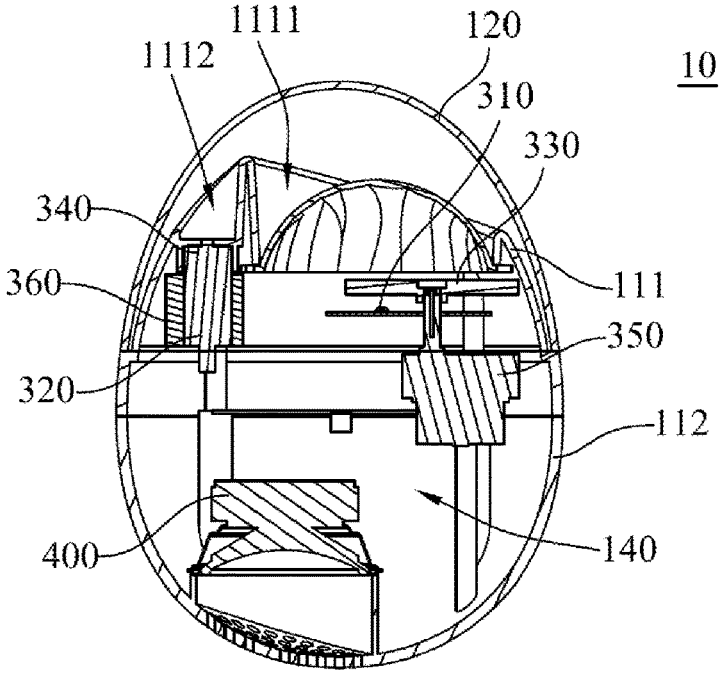
FIG. 3 shows a schematic full cross-sectional view of the light emitting device provided in the first embodiment of the present disclosure.
Figure 4:
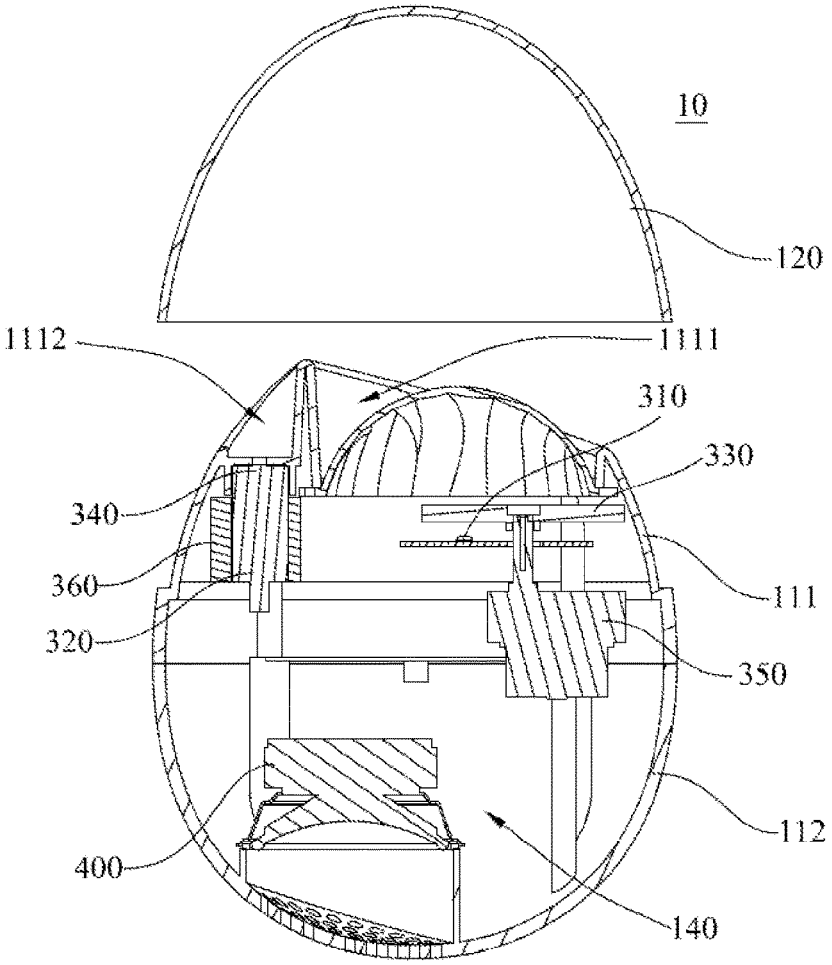
FIG. 4 shows a schematic full cross-sectional view of a second exploded view of the light emitting device provided in the first embodiment of the present disclosure.
Figure 5:
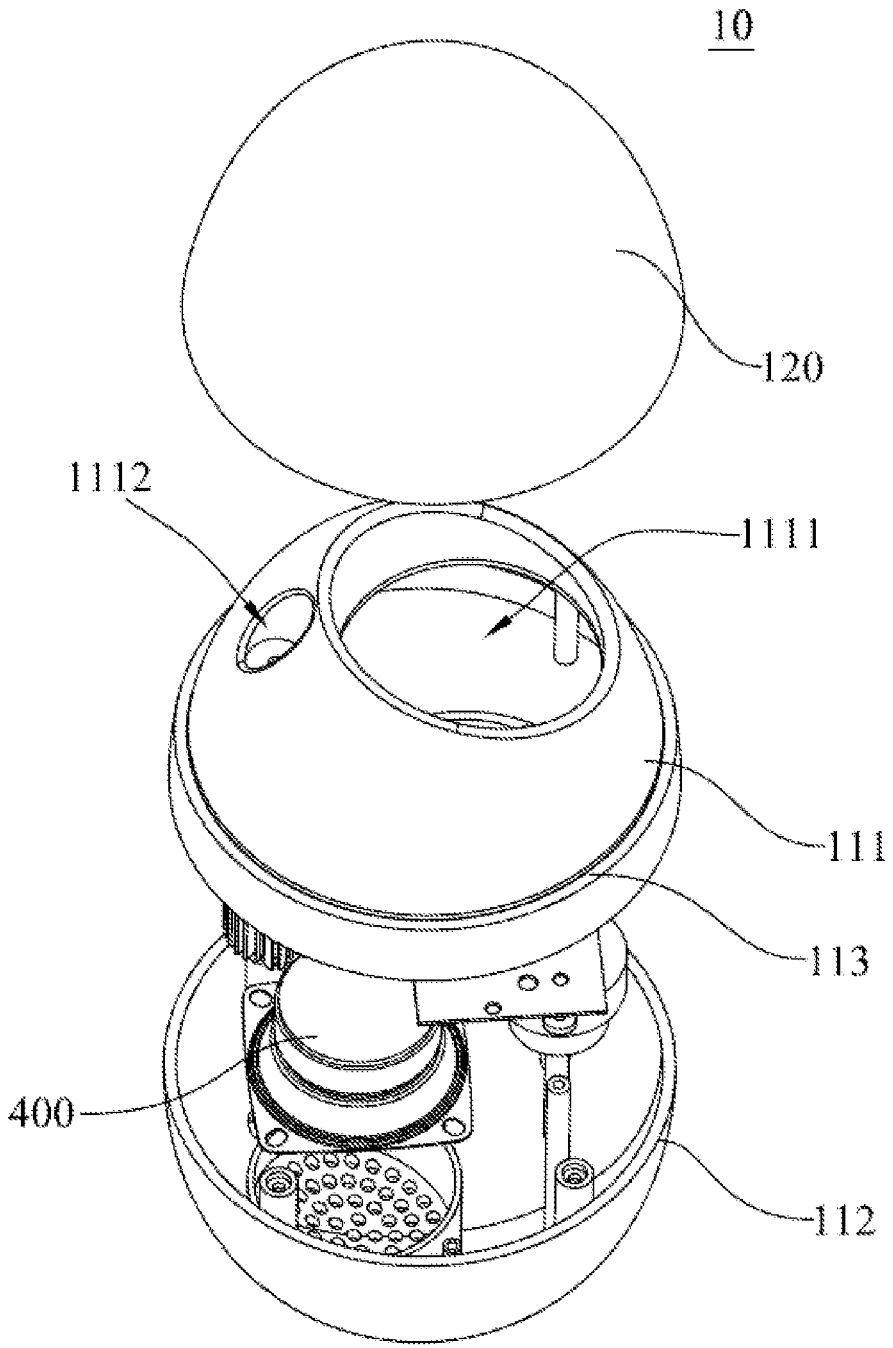
FIG. 5 shows a third schematic exploded view of the light emitting device provided in the first embodiment of the present disclosure, from which the light shield layer is omitted.
Figure 6:
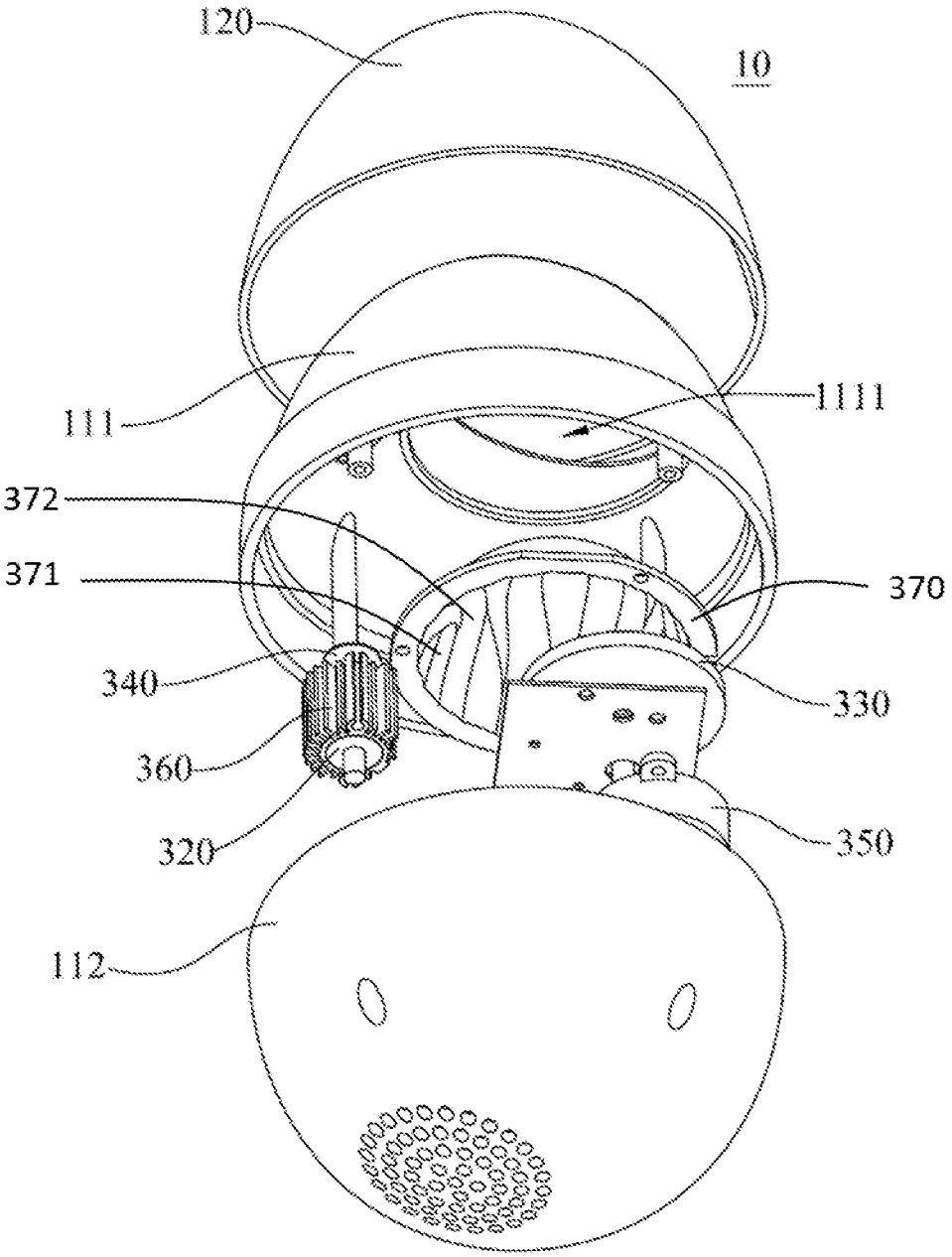
FIG. 6 shows a third schematic exploded view of the light emitting device provided in the first embodiment of the present disclosure, from which the light shield layer is removed.
Figure 7:
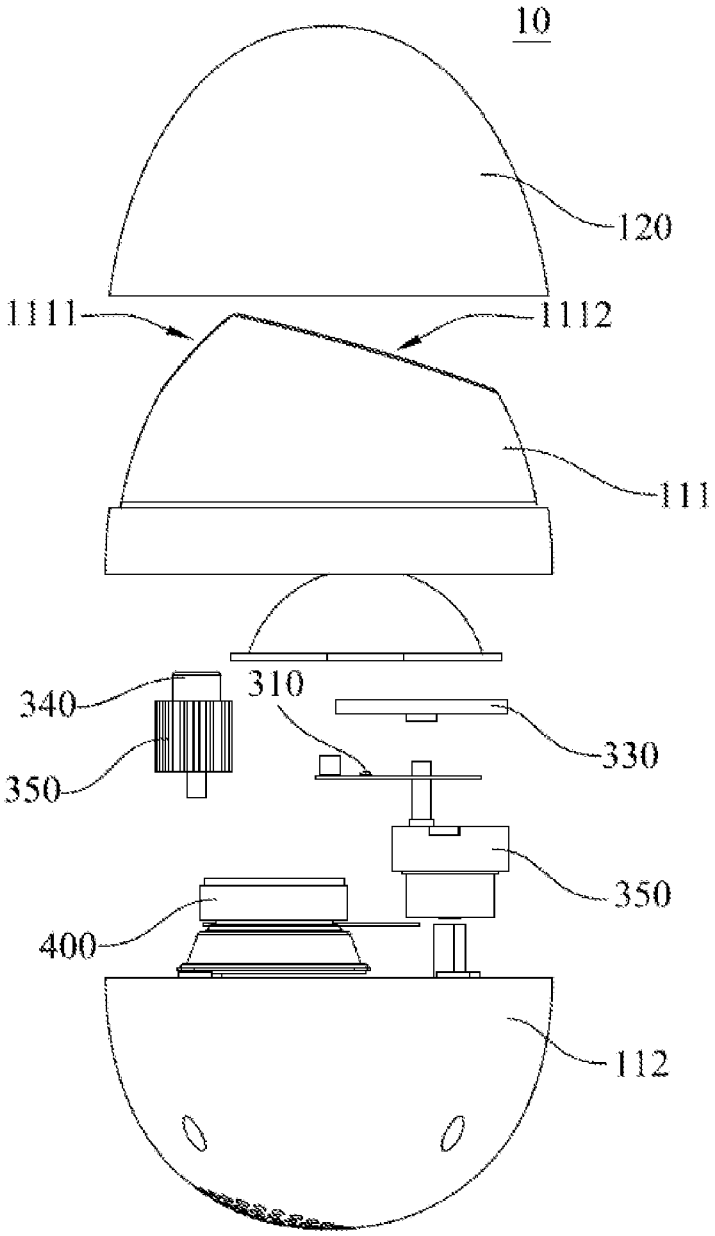
FIG. 7 shows a fourth schematic exploded view of a light emitting device provided in the first embodiment of the present disclosure, from which the light shield layer is removed.

In an alternative embodiment, referring to FIG. 2*c*, the light shield layer 200 may further include a second coating 202 attached on the wall surface of the light transmittable portion 130, and the first coating 201 is attached on a surface of the second coating 202 away from the wall surface of the light transmittable portion 130. The first coating 201 may be crackle paint having a shrinking agent, and the second coating 202 may be primer. The second coating 202 can be applied on the whole wall surface of the light transmittable portion 130, including the first regions 131 and the second regions 132. The first coating 201 may be applied on an entire wall surface of the second coating 202, and after cured, the light shield layer 200 is formed together with the cracks 220.

As a result, portions of the second coating 202 corresponding to the cracks 220 are exposed from first coating 201, i.e., the light shield layer 200. In this case, the second coating 202 may have a color significantly different from the first coating 201, so as to increase a color difference between the light shield layer 200 and the second coating 202 exposed from the cracks 220. Since the color difference is formed between the first coating 201 and the second coating 202, the light transmittable portion 130 in this embodiment can be totally formed transparent.

Likewise, the first coating 201 may not include a shrinking agent. In that case, the first coating 201 is only applied onto the second coating 202 at positions corresponding to the first regions 131 of the light transmittable portion 130 by means of a tool, which preventing the other portions of the second coating 202 corresponding to the second regions 132 from the first coating 201. In this implementation, as soon as the first coating 201 is applied onto the second coating 202, the first regions 131 and the second regions 132 are determined.

In this embodiment, the light shield layer 200 can be advantageously automatically processed, to reduce the processing cost. Moreover, the final arrangement of the light shield layer 200 can well attain the atmosphere of starry sky effect, and enrich the lighting effect of the starry sky projector.

The specific structure of the housing 100 depends on the actual needs. In this embodiment, the housing 100 includes a shell 110 and a cover 120. The shell 110 is substantially closed, and the shell 110 defines an accommodating cavity 140. The light emitting assembly 300 is provided inside the accommodating cavity 140 of the shell 110. The shell 110 includes a first portion 111 and a second portion 112 arranged opposite to and connected with each other. The first portion 111 protrudes toward a direction away from the second portion 112, and the second portion 112 protrudes toward a direction away from the first portion 111. Therefore, the accommodating cavity 140 is defined after the first portion 111 and the second portion 112 are connected.

When the externally visible structure of the housing 100 is exclusively the light transmittable portion 130, both the cover 120 and the shell 110 include light transmittable portions 130.

To enable the light beam emitted by the light emitting assembly 300 to travel through the shell 110, in this embodiment, the first portion 111 of the shell 110 is provided with at least one opening. The first beam can travel through the opening, and project to a wall to present a preset pattern after traveling through the opening.

The cover 120 is configured to be detachably covered outside the first portion 111, and the cover 120 covers the opening when it covers outside the first portion. In this embodiment, when a user is intended to project a pattern on a wall, and feel the effect of light transmitted through the first region 131 and the second region 132, the cover 120 can be removed from the shell 110, to expose the opening, and thus allowing the first beam to travel through the opening and project directly onto the wall. When the user is only intended to feel the effect of light transmitted through the first region 131 and the second region 132, the cover 120 is mounted on the shell 110, and covering the opening. The light emitting device 10 in this embodiment meets the requirement of use in many scenarios, and is more adaptable.

Particularly, the light transmittable portion is distributed in the shell 110 and the cover 120, wherein the cover 120 is defined with the first region 131 and the second region 132, and the first portion 111 and the second portion 112 of the shell 110 are both respectively defined with the first region 131 and the second region 132. In other words, an outer wall surface of the first portion 111 is provided with the light shield layer 200 together with the cracks 220, an outer wall surface of the second portion 112 is provided with the light shield layer 200 together with the cracks, and an outer wall surface of the cover 120 is provided with the light shield layer 200 together with the cracks 220. In this embodiment, the overall appearance of the housing 100 is enabled to present different brightness effects, to give a higher atmosphere.

In this embodiment, a lower end of the first portion 111 is connected with an upper end of the second portion 112. The first portion 111 protrude toward a direction away from the second portion 112, and the outer wall surface of the first portion 111 is provided with an annular flange 113 around the opening, preferably adjacent to the lower end. When the cover 120 is covered outside the first portion 111, an outer peripheral edge of the cover 120 abuts against the annular flange 113. This facilitates the coverage of the cover 120 on the first portion 111.

In this embodiment, the housing 100 is substantially in a shape of a hollow egg structure. The second portion 112 of the shell 110 form a first half of the hollow egg structure, and the first portion 111 with the cover 120 attached thereon together form the second half of the hollow egg structure.

Particularly, the second portion 112 of the shell 110 has a diameter gradually decreases from the first end (i.e., the upper end) facing the first portion 111 towards a second end (i.e., the lower end) away from the first portion 111. The first portion 111 of the shell 110 has a diameter gradually decreases from a first end (i.e., the lower end) facing the second portion 112 towards a second end (i.e., the upper end) away from the second portion 112. The annular flange 113 is provided at an outer periphery of the first portion at the lower end. An annular step 114 is formed between the annular flange 113 and the outer surface of the remaining part of the first portion 111 other than the annular flange 113, that is, the outer diameter of the first portion 111 has a break at the annular step 114. In other words, the outer surface of the remaining part of the first portion 111 is radially recessed relative to the outer periphery of the annular flange 113.

After the first portion 111 and the second portion 112 are connected, an outer periphery of the annular flange 113 of the first portion is flush with the outer periphery of the second portion 112 at the junction.

The cover 120 is attached around the first portion 111 of the shell 110. An end surface of the cover 120 abuts against and connected to the annular step. After connection, an outer periphery of the cover 120 is flush with an outer periphery of the shell 110 at the junction. As such, the whole housing 100 has a smooth outer periphery.

In this embodiment, the first beam includes a first sub-beam and a second sub-beam traveling through the opening. The light emitting assembly 300 includes a first light emitting element 310, a first light transmittable component 330, a drive member 350, a second light emitting element 320 and a second light transmittable component 340.

The first light emitting element 310 is configured to produce the first sub-beam. The first beam can be a parallel beam or a concentric beam. When the first sub-beam is a concentric beam, the first light emitting element 310 emits light at a number of different angles. When the first sub-beam is a parallel beam, the first light emitting element 310 emits light toward a single direction. One or more (two and more) first light emitting elements 310 can be provided, Parameters such as color temperature and tone of the light emitted by the first light emitting element 310 depend on specific requirements. When multiple first light emitting elements 310 are provided, parameters such as color temperature or brightness of the light emitted by each first light emitting element 310 may be the same or different. In this embodiment, one first light emitting element 310 is provided, the light beam emitted by the first light emitting element 310 is a concentric beam, and the first light emitting element 310 is capable of emitting white light.

The first light transmittable component 330 is at least partially arranged in a propagation path of the first sub-beam, to enable the first sub-beam emitted by the first light emitting element 310 to travel through at least a part of the first light transmittable component 330. In this embodiment, the first sub-beam emitted by the first light emitting element 310 is transmitted through a part of the first light transmittable component 330 (the first sub-beam is not transmitted through the entire first light transmittable component 330), and the first sub-beam emitted by the first light emitting element 310 is completely transmitted through the first light transmittable component 330.

In other embodiments, the first sub-beam emitted by the first light emitting element 310 may be transmitted through the entire first light transmittable component 330. Moreover, may be only a part of the first sub-beam emitted by the first light emitting element 310 is transmitted through the first light transmittable component 330, and the other part is not transmitted through the first light transmittable component 330.

In this embodiment, after the first sub-beam emitted by the first light emitting element 310 is transmitted through the first light transmittable component 330, a preset pattern is presented. That is, the first sub-beam transmitted through the first light transmittable component 330 is projected to a surface of an external object, to present a preset pattern. In this embodiment, the first sub-beam transmitted through the first light transmittable component 330 can be projected to a surface of a wall, a curtain and other components, to present a preset pattern. For ease of description, an example is given below in which the first sub-beam is projected to a wall.

The pattern presented by the first sub-beam is defined by the structure of the first light transmittable component 330 or the relative position of the first light transmittable component 330 and the first light emitting element 310. It can be understood that when the structure of the first light transmittable component 330 is different, the pattern presented by the first sub-beam is different. When the relative position of the first light transmittable component 330 and the first light emitting element 310 is different, the pattern presented by the first sub-beam is different. In this embodiment, by changing relative position of the first light transmittable component 330 and the first light emitting element 310, different patterns are projected. When the first light emitting element 310 and the first light transmittable component 330 are located at a first relative position, the beam emitted by the first light emitting element 310 can project a first pattern on the wall after being transmitted through the first light transmittable component 330. When the first light emitting element 310 and the first light transmittable component 330 are located at a second relative position, the beam emitted by the first light emitting element 310 can project a second pattern on the wall after being transmitted through the first light transmittable component 330. The second pattern is different from the first pattern.

Particularly, when at least one parameter such as color, style, size, brightness and position of arrangement of the two patterns is different, the two patterns are considered to be different. The first pattern and the second pattern can be different only in color, only in style, only in size, only in brightness, or only in projection position. In this embodiment, the first pattern and the second pattern have the same projection position, but the styles of the first pattern and the second pattern projected on the wall are different.

The drive member 350 is configured to drive the first light emitting element 310 or the first light transmittable component 330, so that the first light emitting element 310 and the first light transmittable component 330 have different relative positions from each other. In this embodiment, the first light emitting element 310 is fixedly mounted, and the drive member 350 is connected to the first light transmittable component 330, so that the drive member 350 can drive the first light transmittable component 330 to move relative to the first light emitting element 310. Thus, the first light emitting element 310 and the first light transmittable component 330 can be switched between the first relative position and the second relative position.

The drive member 350 can drive the first light transmittable component 330 to rotate relative to the first light emitting element 310. When the drive member 350 drives the first light transmittable component 330 to rotate to a first position, the first light transmittable component 330 and the first light emitting element 310 have a first relative position.

When the drive member 350 drives the first light transmittable component 330 to rotate to a second position, the first light transmittable component 330 and the first light emitting element 310 have a second relative position.

In this embodiment, the drive member 350 may further drive the first light transmittable component 330 to move to other positions, so that the first light transmittable component 330 and the first light emitting element 310 have other relative positions (wherein the other relative positions are relative positions other than the first relative position and the second relative position). When the first light transmittable component 330 and the first light emitting element 310 are located at other relative positions, the first sub-beam emitted by the first light emitting element 310 is transmitted through the first light transmittable component 330 and projected to a wall to present other patterns (wherein the other patterns are patterns different from the first pattern and the second pattern).

According to the light emitting assembly 300 provided in this embodiment, the first sub-beam emitted by the first light emitting element 310 is transmitted through the first light transmittable component 330 and then projected onto a wall, to form the first pattern and the second pattern on the wall that are two different patterns. The light emitting assembly 300 further includes the drive member 350. The drive member 350 can drive the first light transmittable component 330 to rotate relative to the first light emitting element 310, to cause the first light emitting element 310 and the first light transmittable component 330 to locate at the first relative position or the second relative position. Thus, the first light emitting element 310 and the first light transmittable component 330 can be switched between the first relative position and the second relative position. When the first light transmittable component 330 and the first light emitting element 310 are located at the first relative position, the first sub-beam transmitted through the first light transmittable component 330 presents the first pattern. When the first light transmittable component 330 and the first light emitting element 310 are located at the second relative position, the first sub-beam transmitted through the first light transmittable component 330 presents the second pattern that is different from the first pattern. In this manner, the light-emitting element can project at least two different patterns to an ambient environment, so the lighting effect of the light emitting device 300 is enriched and the light emitting assembly 300 can be adapted to different usage scenarios or atmospheres.

In this embodiment, an auroral cover 370 may be provided in a propagation path of the first sub-beam after passing through the first light transmittable component 330. The auroral cover 370 has a hollow semi-spherical shape. The auroral cover 370 has an inner concave surface facing the first light emitting element 310, and an outer convex surface facing the opening. Preferably, the convex surface of auroral cover 370 is aligned with the opening. Specifically, the concave surface of the auroral cover 370 has a plurality of irregular plano-convex lenses 371, the number of which is not less than ten. The irregular plano-convex lenses 371 includes a plurality of irregular long-strip-shaped lenses 372, and the number of the irregular long-strip-shaped lenses 372 is not less than two thirds of the irregular plano-convex lenses 371. The length of the side edge of each irregular long-strip-shaped lens 372 is more than two times of the width thereof.

In this embodiment, the auroral cover 370 is concentric with the first light emitting element 310, that is, a central axis of the auroral cover 370 is coaxial with a central axis of the first light emitting element 310. However, the first light transmittable component 330 has a center offset from central axes of the auroral cover 370 and the first light emitting element 310.

After the first sub-beam passing through the first light transmittable component 330 and the auroral cover 370, irregular long-strip-shaped light spots are formed through the projection of irregular plano-convex lenses 372 on the auroral cover 370. Then, the first light transmittable component 330 is driven by the drive member 350 to change the relative position of the first light transmittable component 330 and the first light emitting element 310, so as to change the pattern presented. As a result, the irregular strip-shaped light bands and spots projected by the auroral cover 370 are changed, thus achieving the streamer effect.

The light emitting assembly 300 in this embodiment may further include a second light emitting element 320 and a second light transmittable component 340. The second light emitting element 320 is configured to produce the second sub-beam. The second light transmittable component 340 is at least partially provided in a propagation path of the second sub-beam. The second sub-beam can present a third pattern after being transmitted through the second light transmittable component 340. In this embodiment, the second sub-beam emitted by the second light emitting element 320 is transmitted through the entire second light transmittable component 340, and the second sub-beam emitted by the second light emitting element 320 is completely transmitted through the second light transmittable component 340. In this embodiment, the first beam is used to project a moving pattern on the wall, and the second beam is used to present a fixed, i.e., stationary, pattern on the projection surface of the wall. By the two patterns in combination, the light emitting assembly 300 is enabled to show better lighting effect.

In other embodiments, the second sub-beam emitted by the second light emitting element 320 may be transmitted through a part of the second light transmittable component 340, or the second sub-beam emitted by the second light emitting element 320 may be partially transmitted through the second light transmittable component 340.

The third pattern presented on the wall by the second sub-beam transmitted through the second light transmittable component 340 may be the same as the first pattern or the second pattern. The third pattern presented on the wall by the second sub-beam transmitted through the second light transmittable component 340 may be different from both the first pattern and the second pattern. In this embodiment, the third pattern is different from both the first pattern and the second pattern.

The light transmission principles of the second light transmittable component 340 and the first light transmittable component 330 may be the same or different. Particularly, in this embodiment, the second light transmittable component 340 defines the second pattern by blocking the second sub-beam. The second light transmittable component 340 includes a base material layer and a pattern layer, and the pattern layer defines the third pattern. That is, the pattern layer is provided with a pattern that is light transmittable. After the second sub-beam is transmitted through the pattern layer, the pattern of the pattern layer is magnified and projected to a projection surface.

The projection direction of the second sub-beam may be the same as or different from the projection direction of the first sub-beam. When the projection direction of the second sub-beam is the same as the projection direction of the first sub-beam, the pattern projected by the second sub-beam onto the projection surface may or may not overlap with the pattern projected by the first sub-beam onto the projection surface. In this embodiment, to make the pattern presented by the second sub-beam cooperate with the pattern presented by the first sub-beam, the projection direction of the second sub-beam is the same as the projection direction of the first sub-beam, and the pattern projected by the second sub-beam onto the wall at least partially overlaps with the pattern projected by the first sub-beam onto the wall. In other words, the light beam emitted by the light emitting assembly 300 to the ambient environment is configured to project a fourth pattern on the wall. The fourth pattern includes the first pattern and the third pattern (when the first light transmittable component 330 and the first light emitting element 310 are located at the first relative position), wherein the first pattern at least partially overlaps with the third pattern. In this embodiment, the first pattern overlays the third pattern. In the solution, the first pattern and the third pattern are combined with each other, to enhance the projection effect.

In this embodiment, the first light emitting element 310 may be an LED light, the second light emitting element 320 may be a laser light, and the second light emitting element 320 and the second light transmittable component 340 are integrated. Moreover, when the first light emitting element 310 is an LED light, the first light emitting element 310 can emit both the first beam and second beam to the ambient environment. It can be understood that the beam emitted by the second light emitting element 320 includes the first sub-beam in the first beam, and the second beam. That is, a part of the beam emitted by the second light emitting element 320 is transmitted through the opening (this transmitted beam is the first beam), and the other part of the beam emitted by the second light emitting element 320 is transmitted through the light transmittable portion 130 of the housing 100 (this transmitted light beam is the second beam). In other embodiments, the light emitted by the first light emitting element 310 can be completely transmitted through the opening, and a third light-emitting element is additionally provided to emit the second beam.

In this embodiment, the opening includes a first hole 1111 and a second hole 1112 that are separated from each other. The first sub-beam is transmitted through the first hole 1111, and the second sub-beam is transmitted through the second hole 1112.

In this embodiment, the first portion 111 is arranged to protrude toward a direction away from the second portion 112, and the first portion 111 has an end portion facing away from the second portion 112. A direction extending from the first portion 111 toward the second portion 112 is defined as a first direction. The first hole 1111 and the second hole 1112 are arranged opposite to each other along a direction perpendicular to the first direction. The first hole 1111 and the second hole 1112 are located at two sides of the end portion, and the first hole 1111 and the second hole 1112 are located at the side of the end portion close to the second portion 112 along the first direction. In the solution, the first hole 1111 and the second hole 1112 are separated by the end portion of the first portion 111 facing away from the second portion 112, such that no interference occurs between the first sub-beam and the second sub-beam.

In this embodiment, the light emitting device 10 further includes a sounding component 400, which is provided inside the second portion 112 of the shell 110, and configured to emit a sound, for example, music, toward a direction away from the first portion 111. In an additional embodiment, the sounding component has a diaphragm facing directly the second light emitting element 320, and the second light emitting element 320 and the first portion 111 of the shell 110 are connected by an elastic member. When the sounding component 400 emits a sound, vibration is transmitted over air to the second light emitting element 320, and the second light emitting element 320 can vibrate relative to the first portion 111 according to the vibration frequency of the sound. This enables the user to observe that the pattern projected by the light beam emitted by the second light emitting element 320 vibrates at a frequency of the music, thus further enhancing the atmosphere.

In this embodiment, the light emitting device 10 further includes a heat radiator 360, and the second light emitting element 320 is arranged at a center of the heat radiator 360. The heat radiator 360 may be a heat sink including fins arranged around the second light emitting element 320, and the heat sink can dissipate heat from the second light emitting element 320.

In other embodiments, the light emitting device 10 may further include a base, configured to support the second portion 112 of the shell 110, and provided with a groove recessed upward. The second portion 112 is inserted in the groove, thus being supported by the base. The second portion 112 is rotatable in the groove, to rotate relative to the base. In this way, the emission direction of the first beam is changed, and the projection angle of the light emitting device 10 is adjusted.

It should be noted that preferred embodiments of the present disclosure are given in the specification and drawings of the present disclosure. However, the present disclosure can be implemented in many different forms, and is not limited to the embodiments described in the specification. These embodiments cause no additional restrictions on the disclosure of the present disclosure, and are provided for thorough and comprehensive understanding of the disclosure of the present disclosure. Moreover, the above technical features can be combined with each other to form various embodiments not listed above, which are all contemplated in the scope of the description of this application. Further, modifications and changes can be made by those skilled in the art in accordance with the above description, which are intended to be contemplated in the protection scope of the appended claims.

What is claimed is:

1. A light emitting device, comprising:

a housing, comprising a light transmittable portion, the light transmittable portion comprising at least one first region and at least one second region;

a light shield layer, covered on a surface of the first region, a plurality of cracks being defined in the light shield layer and corresponding to the second region, the plurality of cracks being randomly distributed and irregular in shape; and a light emitting assembly, arranged in the housing, the light emitting assembly being capable of emitting a beam which travels through the light transmittable portion of the housing to project a pattern, wherein a part of the beam transmitted through the first region and the light shield layer has a first brightness, a part of the beam transmitted through the second region has a second brightness, and the second brightness is greater than the first brightness, wherein the light shield layer comprises a first coating attached to a surface of the first region, and a material of the first coating is partially shield light; and wherein the first coating comprises a shrinking agent, the light shield layer is formed by applying the first coating onto both the first region and the second region, and after the first coating is cured, the light shield layer together with the plurality of cracks are formed, and the plurality of cracks divide the light shield layer into a plurality of irregular segments.

2. The light emitting device according to claim 1, wherein the light shield layer is covered on an outer surface of the light-transmittable portion away from the light emitting assembly.

3. The light emitting device according to claim 1, wherein the first coating is directly attached to the surface of the first region, and the first coating has a color different from a color of the first region.

4. The light emitting device according to claim 1, wherein the light shield layer further comprise a second coating attached to surfaces of the first region and the second region, and the first coating is attached to a surface of the second coating facing away from the light transmittable portion, and wherein the first coating is located at a position corresponding to the first region.

5. The light emitting device according to claim 4, wherein the first coating is crackle paint having a shrinking agent, and the second coating is primer.

6. A light emitting device comprising:

a housing, comprising a light transmittable portion, the light transmittable portion comprising at least one first region and at least one second region;

a light shield layer, covered on a surface of the first region, a plurality of cracks being defined in the light shield layer and corresponding to the second region, the plurality of cracks being randomly distributed and irregular in shape; and a light emitting assembly, arranged in the housing, the light emitting assembly being capable of emitting a beam which travels through the light transmittable portion of the housing to project a pattern, wherein a part of the beam transmitted through the first region and the light shield layer has a first brightness, a part of the beam transmitted through the second region has a second brightness, and the second brightness is greater than the first brightness;

wherein the housing comprises a shell defining an accommodating cavity where the light emitting assembly is arranged, the shell is provided with a first hole and a second hole, the first hole and second hole being separated from each other and inclined to each other, the light emitting assembly being capable of emitting another beam which comprises a first sub-beam passing through the first hole and a second sub-beam passing through the second hole.

7. The light emitting device according to claim 6, wherein the shell comprises a first portion defining the first hole and second hole; and a second portion connected to the first portion, wherein the first portion and the second portion cooperatively define the accommodating cavity; and wherein the light transmittable portion is distributed in the first portion and the second portion of the shell.

8. The light emitting device according to claim 7, wherein the housing further comprises a cover detachably attached to the first portion of the shell; the cover covers the first hole and second hole when the cover is attached to the shell; and wherein the light transmittable portion is distributed in the cover.

9. The light emitting device according to claim 8, wherein the housing is substantially in a shape of a hollow egg, the second portion of the shell form a first half of the hollow egg structure, and the first portion with the cover attached thereon together form a second half of the hollow egg structure.

10. The light emitting device according to claim 8, wherein the first portion protrudes toward a direction away from the second portion, an outer wall surface of the first portion is provided with an annular flange around the first hole and second hole, and when the cover is covered outside the first portion, an outer peripheral edge of the cover abuts against the annular flange.

11. The light emitting device according to claim 10, wherein when the cover is attached to the first portion, an outer surface of the cover is flush with an outer surface of the annular flange.

12. The light emitting device according to claim 6, wherein the light emitting assembly comprises:

a first light emitting element for emitting the first sub-beam;

a first light transmittable component, at least partially provided in a propagation path of the first sub-beam;

a drive member for driving the first light emitting element or the first light transmittable component, to cause the first light emitting element and the first light transmittable component to switch between a first relative position and a second relative position, wherein when the first light transmittable component and the first light emitting element are located at the first relative position, the first sub-beam transmitted through the first light transmittable component presents a first pattern; and when the first light transmittable component and the first light emitting element are located at the second relative position, the first sub-beam transmitted through the first light transmittable component presents a second pattern that is different from the first pattern.

13. The light emitting device according to claim 12, wherein the light emitting assembly further comprises an auroral cover arranged in a propagation path of the first sub-beam, the auroral cover has an inner concave surface facing the first light emitting element, and the auroral cover has a plurality of irregular plano-convex lenses on the concave surface, and the plurality of irregular plano-convex lenses comprises a plurality of irregular long-strip-shaped lenses.

14. The light emitting device according to claim 12, wherein the light emitting assembly further comprises:

a second light emitting element for emitting the second sub-beam; and a second light transmittable component, at least partially provided in a propagation path of the second sub-beam, wherein the second sub-beam transmitted through the second light transmittable component presents a third pattern.

15. The light emitting device according to claim 12, wherein the first light emitting element is further used to emit the beam.

16. A light emitting device, comprising:

a housing comprising a light transmittable portion;

a light shield layer covered on a surface of the light transmittable portion; and a light emitting assembly arranged in the housing, the light emitting assembly being capable of emitting a beam which is able to transmit through the light transmittable portion, wherein a plurality of elongated cracks which are irregular in shapes, lengths or widths and intersect each other at a plurality of intersections are formed in the light shield layer, the beam transmitted through a part of the light transmittable portion with the light shield layer has a first brightness, and the beam transmitted through a part of the light transmittable portion corresponding to the cracks has a second brightness greater than the first brightness.

* * * * *